US007232342B2

(12) United States Patent
Kubota

(10) Patent No.: US 7,232,342 B2
(45) Date of Patent: Jun. 19, 2007

(54) FUSE CAVITY AND ELECTRIC JUNCTION BOX EQUIPPED THEREWITH

(75) Inventor: Katsuhiro Kubota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/566,272

(22) PCT Filed: Jul. 8, 2004

(86) PCT No.: PCT/JP2004/010061

§ 371 (c)(1),
(2), (4) Date: Jan. 30, 2006

(87) PCT Pub. No.: WO2005/013307

PCT Pub. Date: Feb. 10, 2005

(65) Prior Publication Data

US 2006/0199404 A1 Sep. 7, 2006

(30) Foreign Application Priority Data

Jul. 31, 2003 (JP) ..... 2003-204376

(51) Int. Cl.
*H01R 13/68* (2006.01)

(52) U.S. Cl. ..... 439/620.33

(58) Field of Classification Search ..... 439/622, 439/623, 621, 651, 620.33, 620.34, 620.27, 439/620.26, 698
See application file for complete search history.

(56) References Cited

U.S. PATENT DOCUMENTS

| | | | |
|---|---|---|---|
| 5,215,479 | A | 6/1993 | Araki et al. |
| 5,632,654 | A | 5/1997 | Sugiura |
| 6,089,918 | A | 7/2000 | Arakelian et al. |
| 2002/0126462 | A1 | 9/2002 | Roussel et al. |
| 2003/0025506 | A1 | 2/2003 | Arai |

FOREIGN PATENT DOCUMENTS

| | | |
|---|---|---|
| EP | 1 130 616 A2 | 9/2001 |
| EP | 1 130 616 A3 | 9/2001 |
| EP | 1 139 373 A2 | 10/2001 |
| JP | 2002-236156 | 8/2002 |
| JP | 2002-252901 | 9/2002 |
| JP | 2003-177164 | 6/2003 |

*Primary Examiner*—Phuong Dinh
(74) *Attorney, Agent, or Firm*—Armstrong, Kratz, Quintos, Hanson & Brooks LLP

(57) ABSTRACT

A low-profile fuse (10) includes a tab terminal (15) provided at an end of a fuse element (17), and a protective projection (12) provided in a middle part (11*c*) of a fuse body (11) for protecting the fuse element (17). Said low-profile fuse (10) is adapted to a housing (50) of a fuse cavity (55). Guides (67A), (67B) is provided on the housing (50) for preventing the low-profile fuse (10) from being inserted obliquely into the housing (50). Said guides (67A), (67B) of the housing (50) are allowed to make contact with the protective projection (12) of the fuse (10). Slopes (67*c*), (67*d*), (67*e*), (67*f*) are provided on the guides (67A), (67B). The guides (67A), (67B) are taller than the terminal (30) mounted on the housing (50). This fuse cavity is provided in an electric junction box (1).

4 Claims, 11 Drawing Sheets

FUSE CAVITY AND ELECTRIC JUNCTION BOX EQUIPPED THEREWITH

TECHNICAL FIELD

This invention relates to an electric junction box and a fuse cavity provided thereon for use in a vehicle and the like.

BACKGROUND ART

FIGS. 18 and 19 show a conventional fuse cavity 155 and an electric junction box 101. As shown in FIG. 18, a mini fuse 20 is a tall fuse, having a fuse body 21 made of synthetic resin, a pair of metallic tab terminals 25 projecting from both sides of the fuse body 21.

A metallic fuse element 27 having a substantially horizontal S shape is provided in the fuse body 21. The fuse element 27 electrically connects the pair of tab terminals 25 to each other. Further, when an excessive current flows through a circuit connected to the fuse element 27, the fuse element melts to break the circuit.

As shown in FIGS. 18 and 19, by attaching the tall fuse 20 to a housing 150, a forked terminal 30, being mounted on a receiving part 172 of the housing 150, comes into contact with the tab terminal 25 of the fuse 20 to be electrically connected to the tab terminal 25. At this moment, since the tab terminal of the fuse 20 is inserted into a pair of clipping arms 31 of the forked terminal 30, the fuse 20 and a bus bar 140 are electrically connected to each other.

However, in a combination of the conventional fuse cavity 155 and the junction box 101, when the fuse 20 is inserted obliquely into the housing 150, it is possible that an edge 26*a* formed at a tip 26 of the tab terminal 25 may penetrate into a gap between a peripheral part 31*a* of the clipping arms 31 and a side wall 161 of the housing 150.

When the tab terminal 25 is inserted deeply into the gap, the forked terminal 30 may be deformed permanently. The tab terminal 25 may be also deformed permanently. If the clipping arms 31 of the forked terminal 30 are deformed permanently, the clipping arms may no longer hold the tab terminal 25 firmly as before. Further, such a problem may not only happen when the fuse 20 is attached to the housing 150 as shown in FIGS. 18 and 19, but also may happen among other combinations of fuses and housings.

In view of above described problems, an object of this invention is to provide an electric junction box with a fuse cavity, which can reliably prevent a terminal mounted on a housing of the junction box from being deformed permanently.

DISCLOSURE OF INVENTION

In order to attain said object, according to this invention as there is provided a fuse cavity having a housing to receive a fuse, comprising:

said fuse includes a fuse element;

terminals provided at both ends of the fuse element; and a fuse body, characterized in that a protecting projection protruding from a middle part of said fuse body for protecting the fuse element, that said housing has a guide formed at an inner part thereof, said guide being allowed to contact with said protecting projection of the fuse body so as to prevent said fuse from being inserted obliquely into the housing.

According to this structure, when the fuse is inserted into the housing, the protecting projection is slid on the guide at the same time. Therefore, the fuse is prevented from being inserted obliquely into the housing, and properly attached to the housing. Thus, a damage as a permanent deformation of the terminal, caused by the terminal of the fuse penetrating into the gap between the inner wall of the housing and the terminal mounted on the housing, is prevented.

According to this invention, there is provided the fuse cavity, wherein a slope is provided at the guide of said housing.

According to this structure, when the fuse is inserted into the housing, the slope, which is formed on an upper side of the guide of the housing, guides the fuse. Therefore, the fuse is easily inserted into the housing.

According to this invention, there is provided the fuse cavity, wherein the guide of said housing is made taller than the terminal mounted on the housing.

According to this structure, when the fuse is inserted into the housing, the guide of the housing comes in contact with the projection of the fuse earlier than the terminal mounted on the housing comes in contact with the terminal of the fuse. Therefore, a damage as a permanent deformation of the terminal, caused by the terminal of the fuse penetrating into the gap between the inner wall of the housing and the terminal mounted on the housing, is prevented.

According to this invention, there is provided an electric junction box comprising the fuse cavity.

According to this structure, said electric junction box allows the fuse to be properly attached to the fuse cavity thereof. In addition, the terminal, being mounted on the housing in said electric junction box, can be protected from a damage caused by oblique insertion of the fuse.

BEST MODE FOR CARRYING OUT THE INVENTION

In the following, one embodiment of a fuse cavity and an electric junction box according to the present invention will be explained with reference to the attached drawings.

Figure 2:
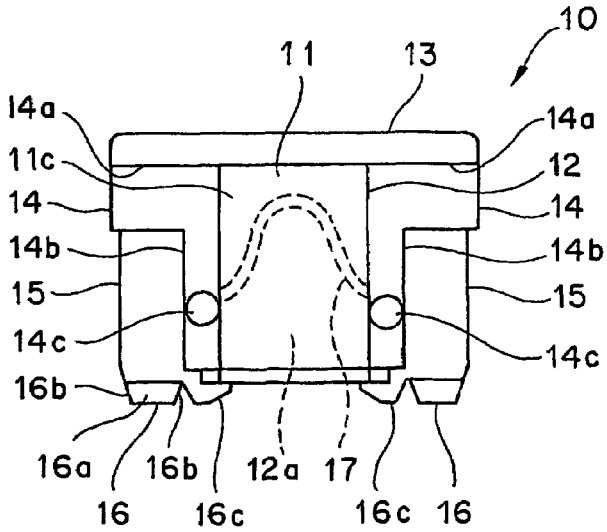
FIG. 2 is a front view showing a fuse for use in the one embodiment of the electric junction box having a fuse cavity according to this invention.
Figure 10:
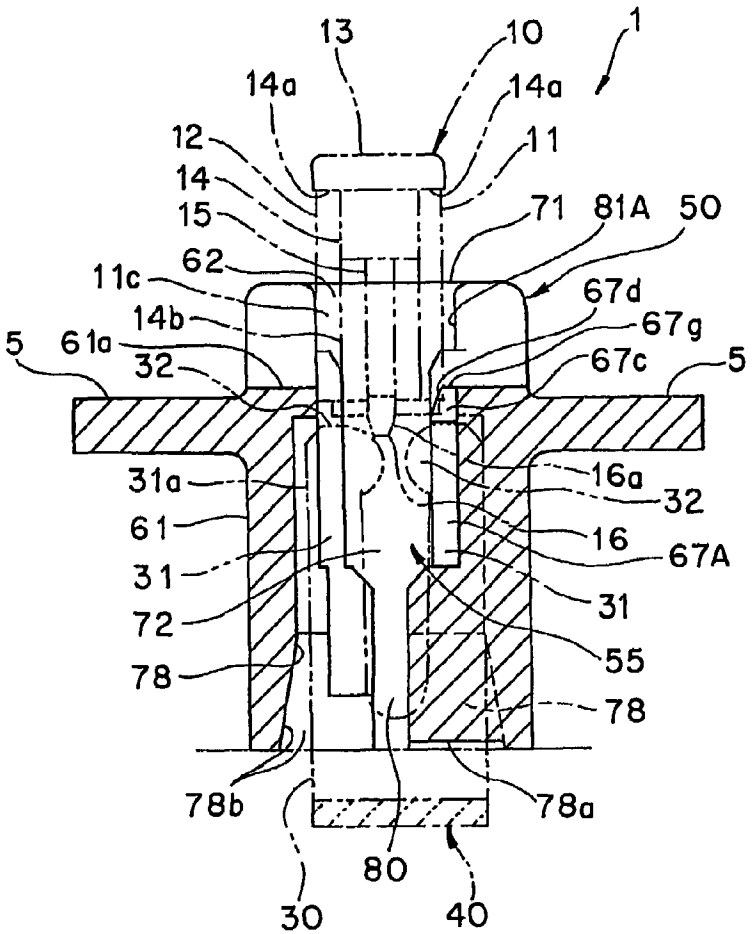
FIGS. 10 to 12 are transverse cross section views showing the states in which the low-profile fuse is being inserted into the housing.

As shown in FIG. 2, a low-profile fuse 10 includes a fuse body 11 made of synthetic resin, and a pair of metallic tab terminals 15 disposed at both sides of the fuse body 11. As shown in FIGS. 2 and 10, the fuse body 11 includes a head 13, a protecting projection 12 extending from the head 13 for protecting a fuse element 17, and a pair of lower projections 14 protruding lower than said protecting projection 12. The lower projections 14 are projected at both sides of the protecting projection 12. Further, a tab terminal 15 is projected from the lower projection 14 along a narrower part 14*b* of the lower projection 14. An engaging part 14*c* securely aligns and fixes the tab terminal 15 to the fuse body 11.

The protecting projection 12 is disposed around a middle part 11*c* of the fuse 11. When an excessive current flows into the fuse 10 from an electric circuit electrically connected thereto, the substantially U-shape metallic fuse element 17 melts to open the circuit. The protective projection 12 is formed as an insulating housing 12 in a substantially rectangular box shape. A chamber 12*a* having a substantially rectangular box shape is provided in the insulating housing 12 for receiving the fuse element 17.

Figure 12:
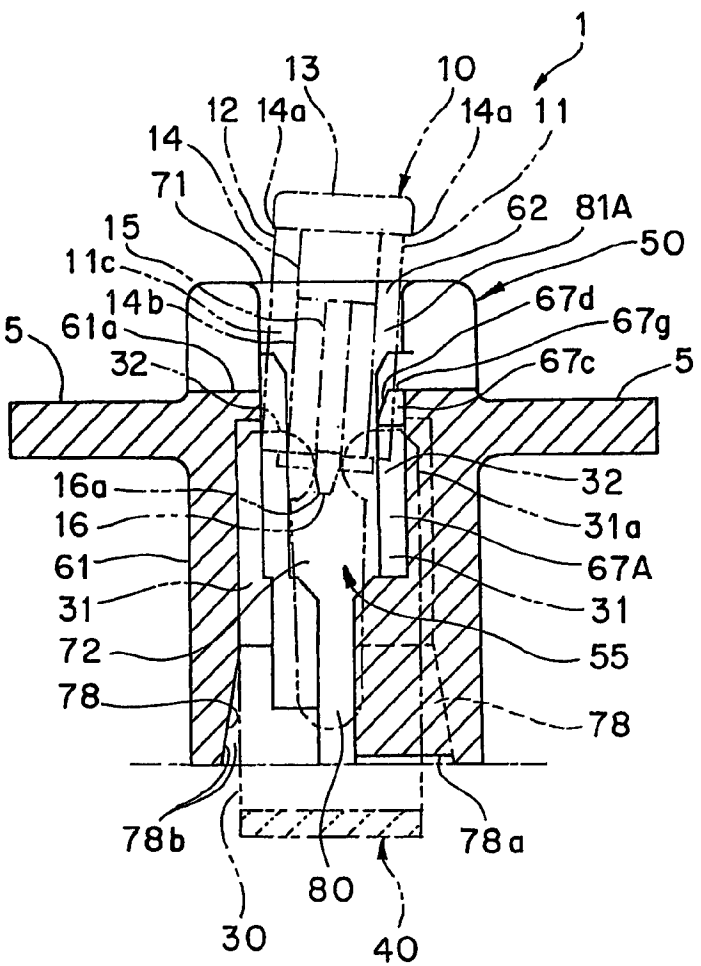

A wider edge 16*a* and a narrower edge 16*b* are provided at a tip 16 of the tab terminal 15. As shown in FIG. 12, when the tab terminal 15 is inserted into the clipping arms 31 of the forked terminal 30 of a bus bar 40, the wider edge 16*a* of the tip 16 of the tab terminal 15 pushes a pair of resilient free ends 32 of the clipping arms 31. Therefore, as shown in FIG. 13, the tab terminal 15 of the fuse 10 being attached to a housing 50 is firmly clipped by the pair of free ends 31 of the forked terminal 30.

Further, for easily pulling out the fuse 10 from the housing 50, as shown in FIGS. 2 and 10, a tool engaging part 14*a* in a step shape is provided on the fuse body 11. Said step shape of the tool engaging part 14*a* is adapted to a tip of a fuse remover such as a fuse puller (not shown). The tool engaging part 14*a* includes at least the head 13 and a projection 14. Further, the low-profile fuse 10 is also known as a miniature fuse 10.

Figure 18:
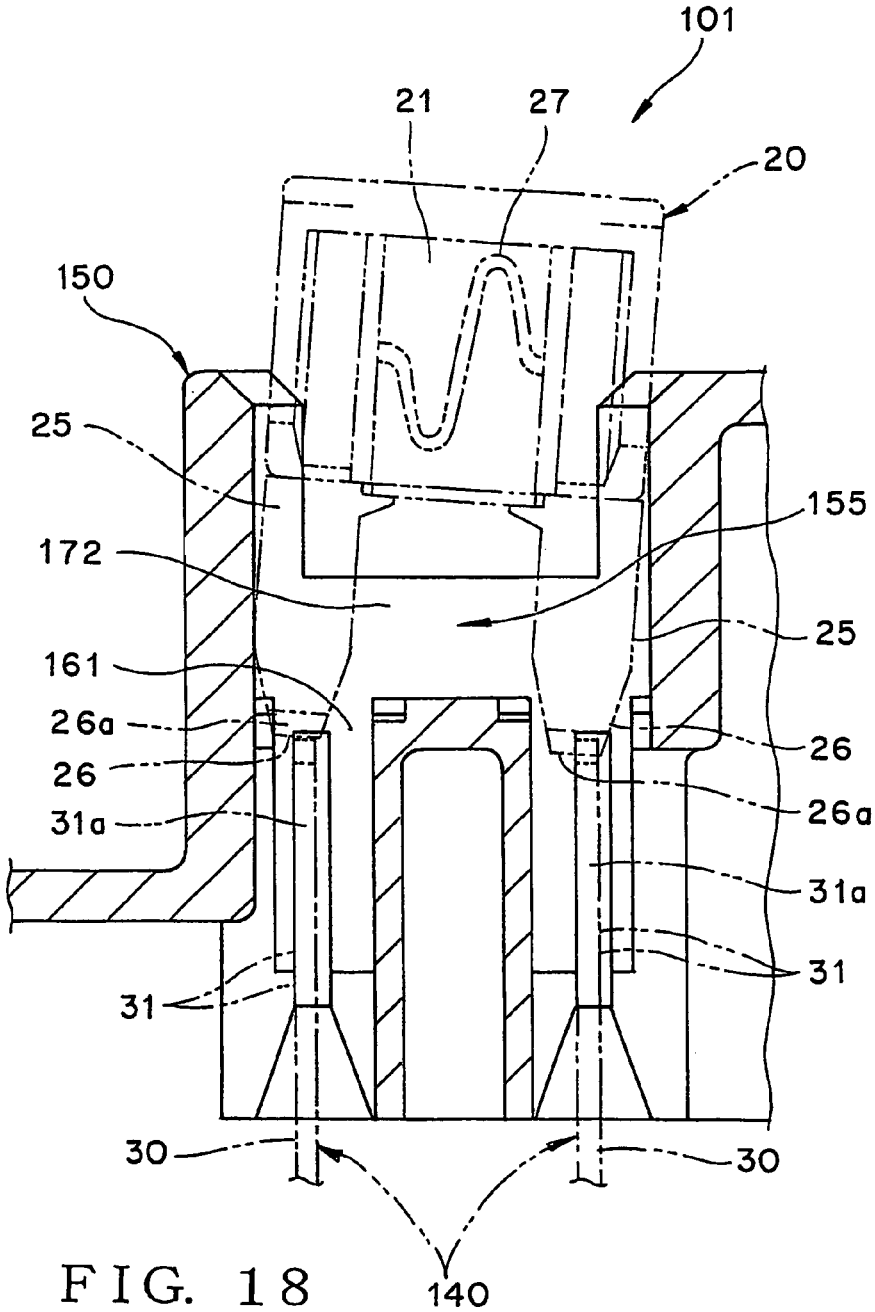
FIG. 18 is a longitudinal cross section view showing one embodiment of a conventional electric junction box having a conventional fuse cavity.
Figure 19:
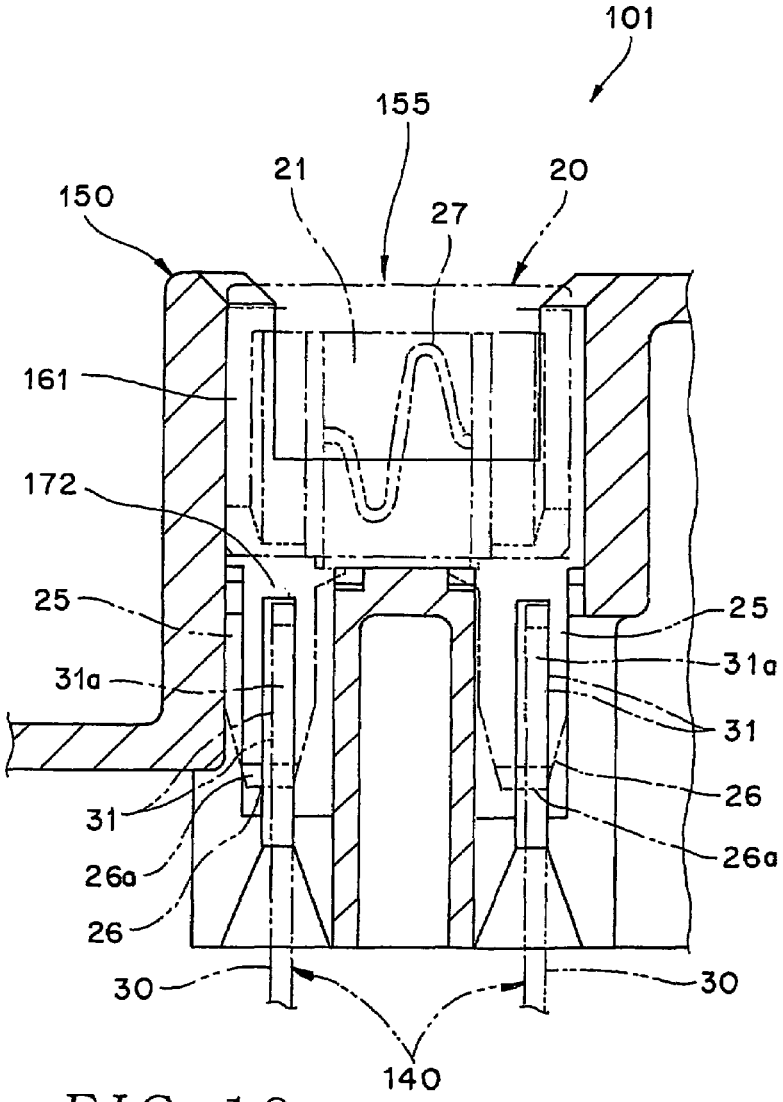
FIG. 19 is a longitudinal cross section view showing a state in which the tall fuse is attached to the conventional electric junction box having the conventional fuse cavity.

The low-profile fuse 10 in FIG. 2 is substantially half height of the tall fuse 20 in FIG. 18. Such a low-profile fuse 10 is achieved by disposing the tab terminals 15 at both ends of the fuse element 17 in the fuse body 11.

Figure 5:
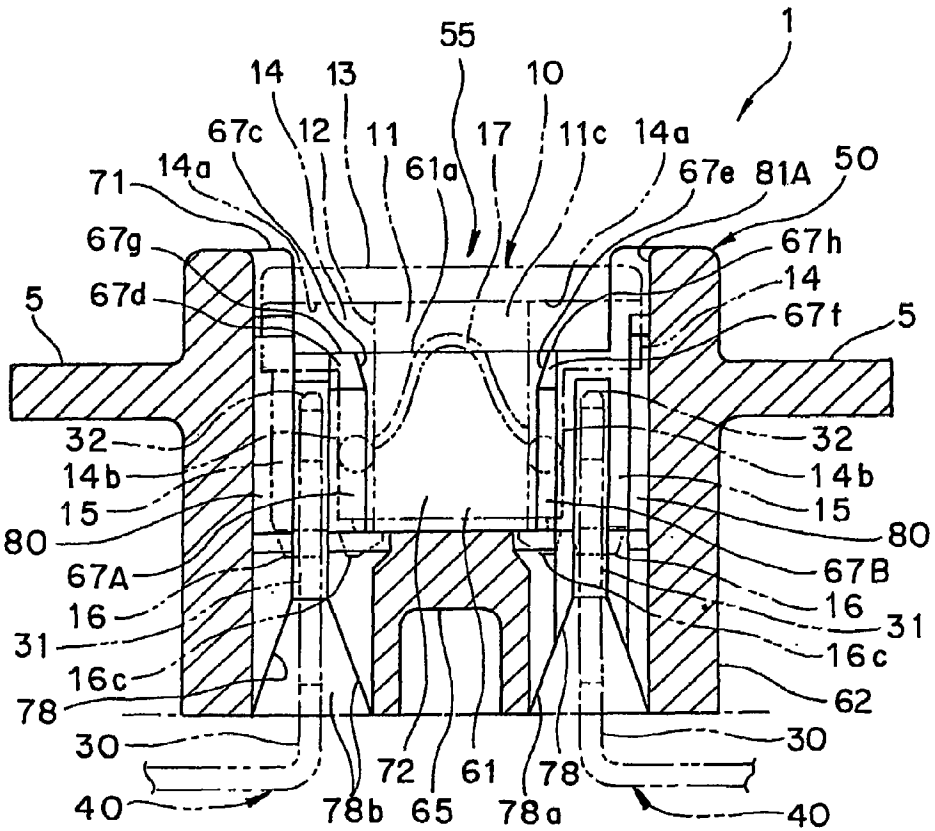
FIG. 5 is a longitudinal cross section view taken on line D—D of FIG. 16, showing a state in which the low-profile fuse is attached to the housing.
Figure 13:
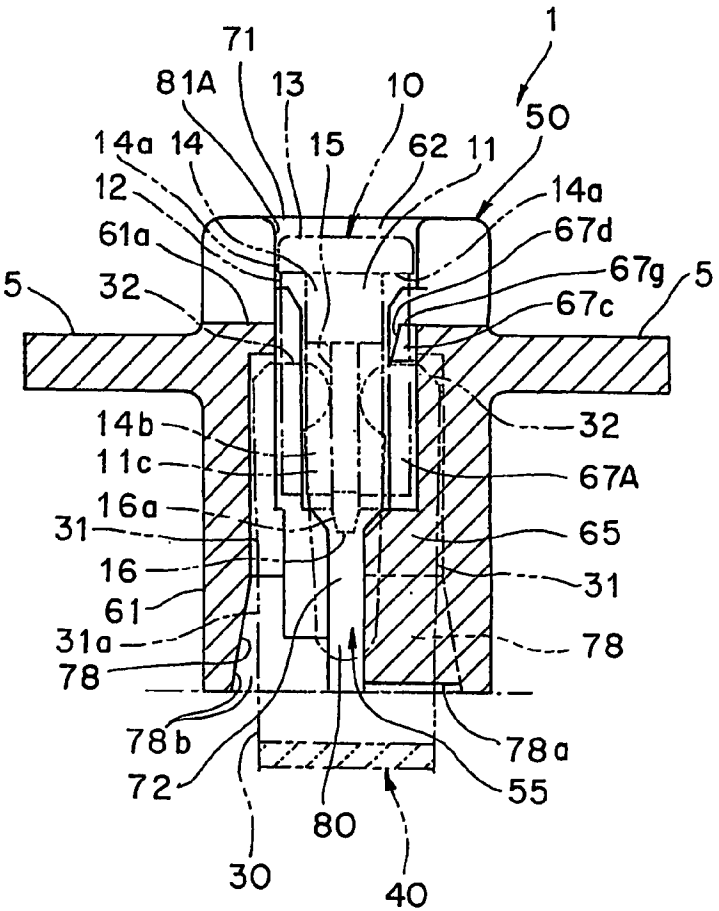
FIG. 13 is a transverse cross section view taken on line E—E of FIG. 16, showing the state in which the low-profile fuse is to be attached to the housing.

As shown in FIGS. 5 and 13, the low-profile fuse 10 received in a chamber 72 of the housing 50 is hard to be pulled out by hand. The low-profile fuse 10 and the fuse 20 are pulled out from the housing 50 by a tool (not shown) such as a fuse puller.

The fuse low-profile fuse 10 is inserted through an opening 71 and mounted in a chamber 72 both provided in the housing 50 made of synthetic resin. Further, the fuse 20 is also inserted through the opening 71 and mounted in the chamber 72 of the housing 50. Thus, both the low-profile fuse 10 and the fuse 20 are mounted in a fuse cavity 55 of the housing 50.

Figure 1:
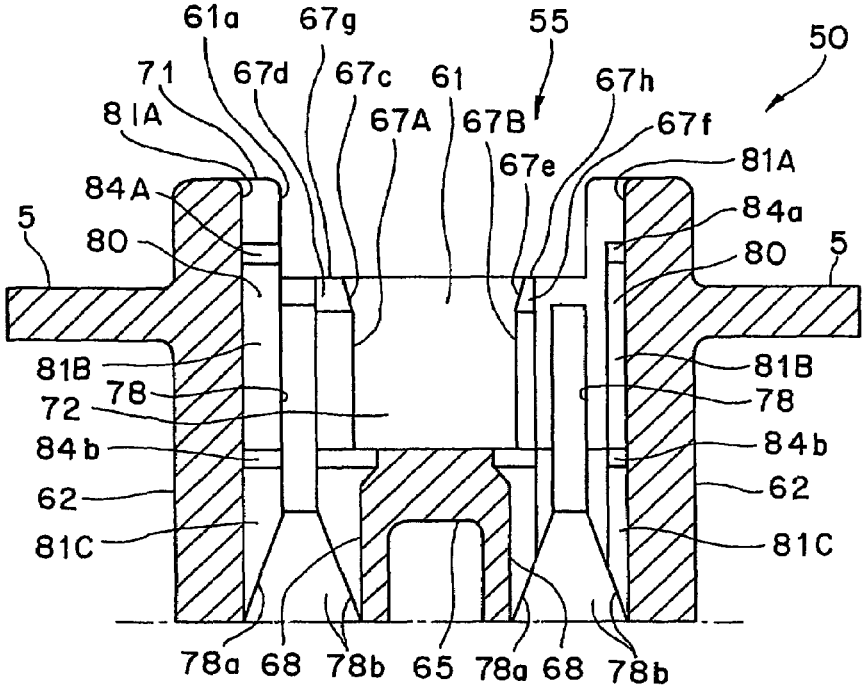
FIG. 1 is a longitudinal cross section view taken on line A—A of FIG. 15, showing a housing for use in one embodiment of an electric junction box having a fuse cavity according to this invention.
Figure 8:
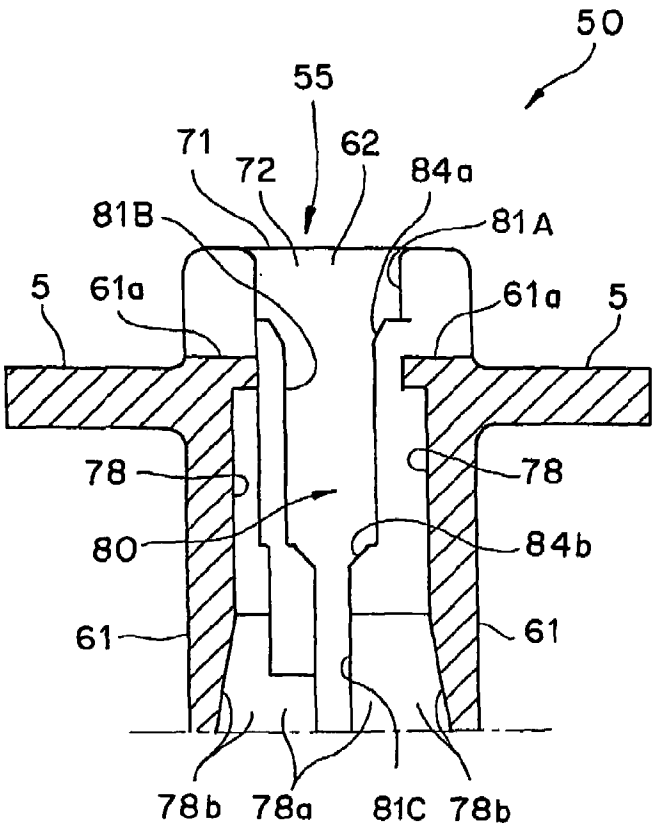
FIG. 8 is a transverse cross section view of the housing taken on line B—B of FIG. 15.
Figure 9:
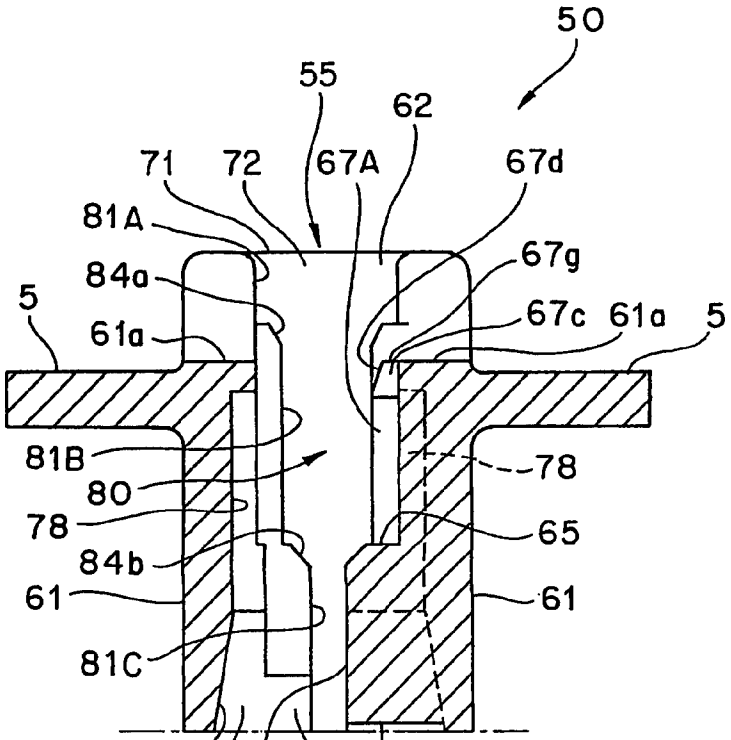
FIG. 9 is a transverse cross section view of the housing taken on line C—C of FIG. 15.

As shown in FIGS. 1, 8 and 9, the fuse cavity 55 includes a pair of side walls 61, a pair of side walls 62 perpendicular to the side walls 61, and a bottom wall 65 perpendicular to the side walls 61 and the side walls 62. The fuse cavity 55 is formed in the housing 50. The housing 50 is provided on a substrate 5 of an electric junction box 1.

Figure 15:
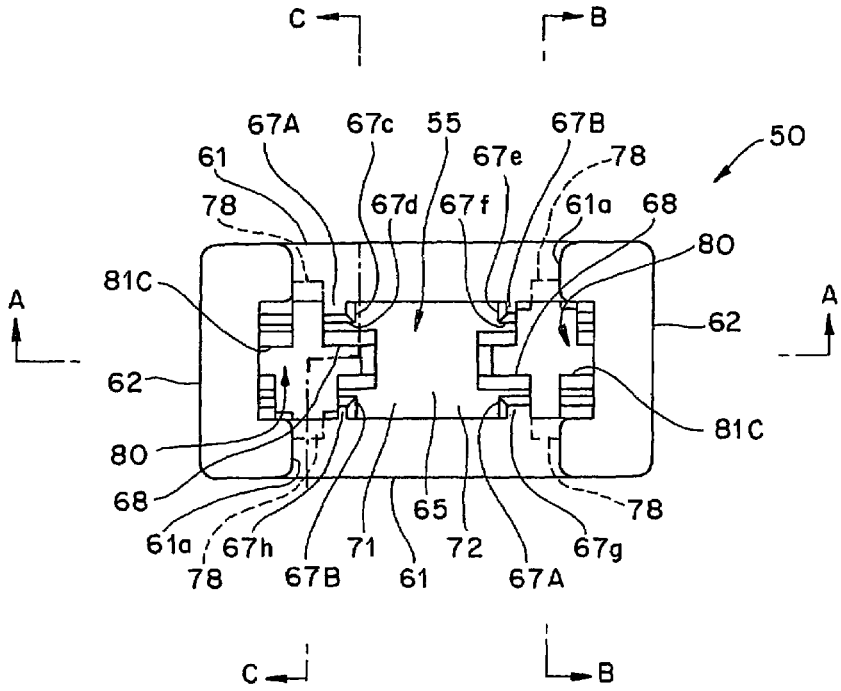
FIG. 15 is a front view of the housing.
Figure 16:
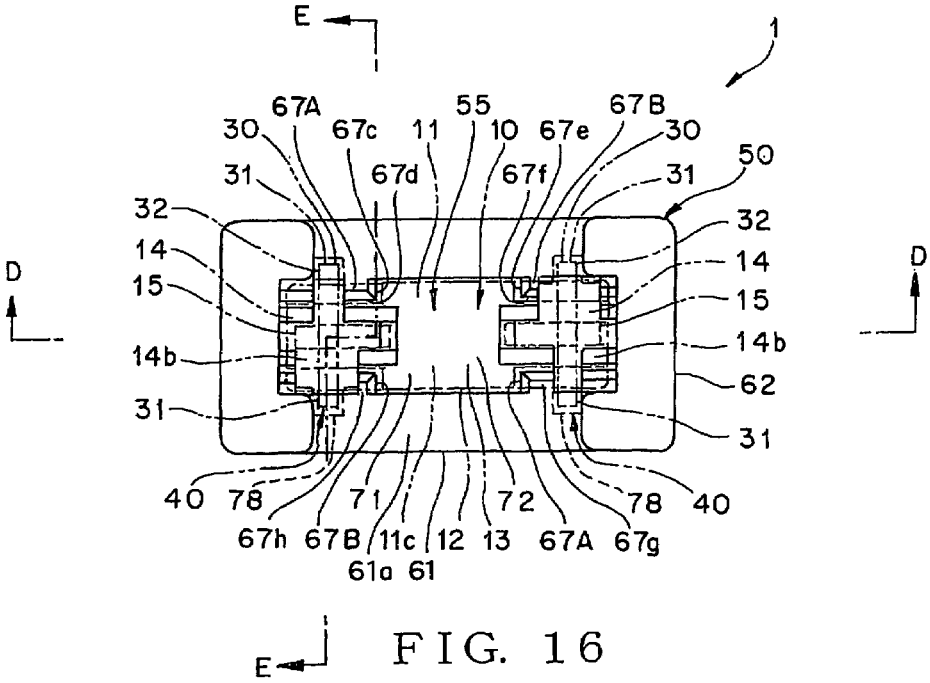
FIG. 16 is a front view showing the state in which the low-profile fuse is attached to the housing.
Figure 17:
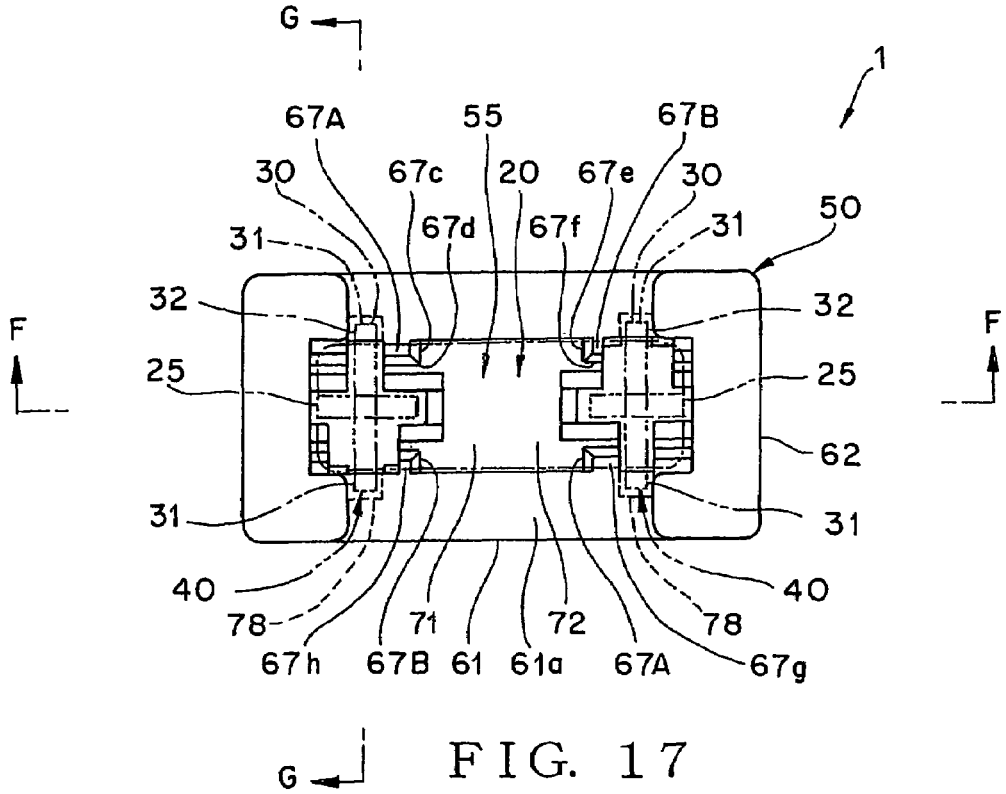
FIG. 17 is a front view showing the state in which the tall fuse is attached to the housing.

As shown in FIGS. 8, 9, and 15, fuse cavities also can be formed by a plurality of side walls 61 arranged in parallel and a pair of side walls 62 extending along said side walls 61. In this case, said side walls 61 separate the chambers 72. Further, a notch 61*a* shown in FIGS. 1, 8 and 9, having a substantially rectangular shape part, is formed on one of said one pair of wide walls 61 of the housing. Said notch 61*a* is adapted to a tip of the tool such as a fuse puller (not shown).

As shown in FIGS. 1, 9 and 15, guides 67A, 67B are projected inward from the side walls 61 toward the chamber 72 of the fuse cavity 55 for preventing the low-profile fuse 10 from being inserted obliquely. As shown in FIGS. 1 and 9, the guides 67A, 67B are projected lines extending in a vertical direction. Other shapes, such as ribs, are acceptable as said guides.

As shown in FIG. 10, the protective projection 12 of the low-profile fuse 10 can contact with, and slide on the guides 67A, 67B of the one side wall 61 of the housing 50. Further, as shown in FIG. 3, the narrower part 14*b* of the lower projection 14 of the low-profile fuse 10 can contact with, or slide on the guides 67A, 67B of the one side wall 61 of the housing 50.

Figure 3:
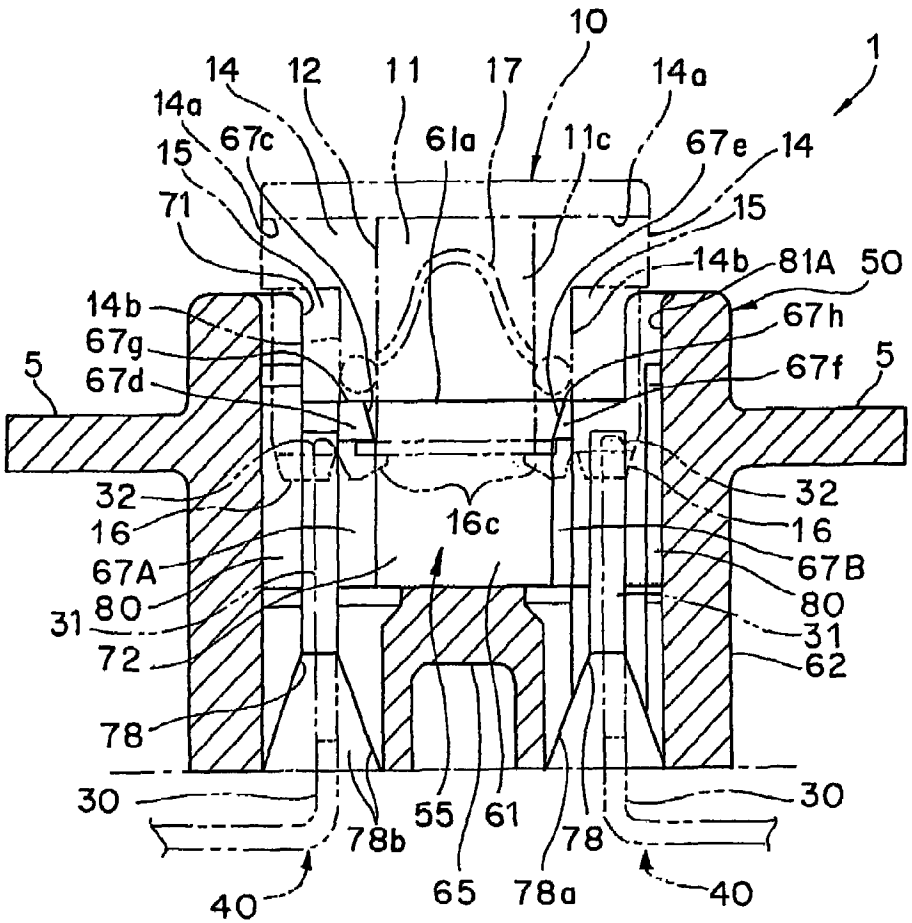
FIG. 3 is a longitudinal cross section view showing the one embodiment of the electric junction box having a fuse cavity according to this invention.

As shown in FIGS. 3, 10 and 15, the forked terminal 30 of the bus bar 40 is inserted into grooves 78 formed on the side walls 61 of the housing 50. As the curved free ends 32 of the forked terminal 30 of the bus bar 40 is guided by a guide surface 78*b* of an insertion hole 78*a* of the groove 78, the bus bar 40 is inserted into the groove 78, and fixed to the groove 78 of the housing 50. Said metallic bus bar 40 having the forked terminal 30 at its end is bent at right angle and disposed in substantially parallel to the substrate 5.

Figure 4:
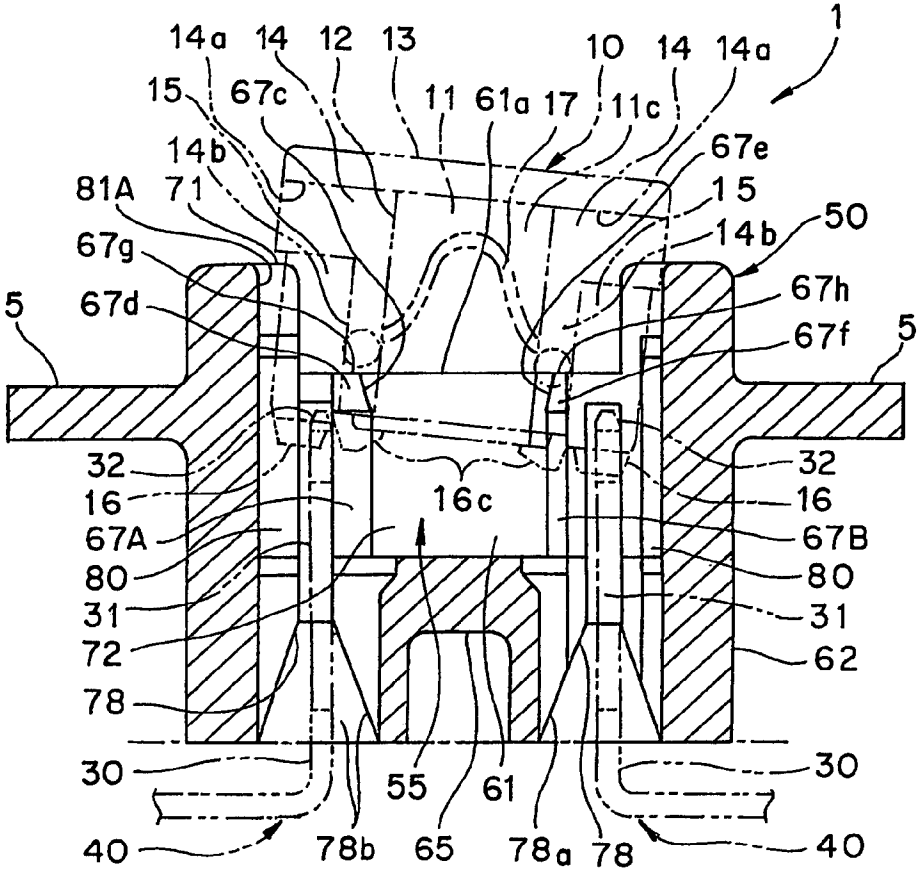
FIG. 4 is a longitudinal cross section view showing a state in which a low-profile fuse is being attached to the housing according to this invention.
Figure 11:
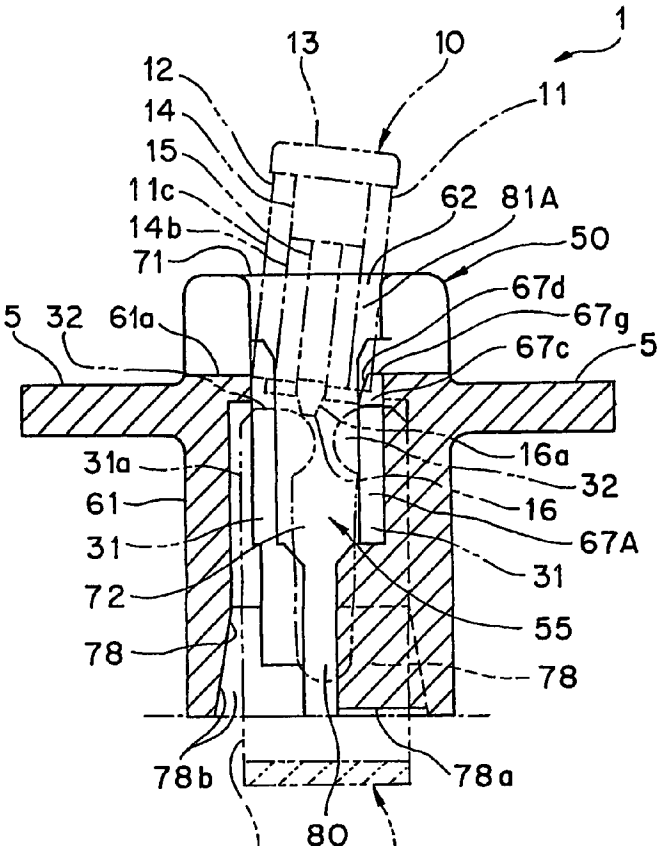

As shown in FIGS. 3, 4 and 5, by the low-profile fuse 10 being attached to the housing 50, the forked terminal 30 mounted in the chamber 72 of the housing 50 is electrically connected to the tab terminal 15 of the low-profile fuse 10. As shown in FIGS. 10 to 12, when the tab terminal 15 is connected to the forked terminal 30, the tab terminal 15 is inserted tightly into between the pair of free ends 31 of the forked terminal 30. Thus, as shown in FIG. 13, the low-profile fuse 10 is electrically connected to the bus bar 40.

As shown in FIGS. 4, 11 and 12, when the low-profile fuse 10 is going to be inserted obliquely into the housing 50, the protective projection 12 is slid on the guides 67A, 67B, as the low-profile fuse 10 is inserted into the chamber 72 of the housing 50. Therefore, as shown in FIGS. 5 and 13, the low-profile fuse 10 is properly attached to the housing 50.

Further, for example, it can be previously prevented from occurring that the tip 16 of the tab terminal 15 or a projection 16*c* continued laterally to the tip 16 penetrates between an interior of the side walls 61 and the peripheral part 31*a* of the forked terminal 30, and consequently the forked terminal 30 or the tab terminal 15 is deformed or damaged permanently. The forked terminal 30 of the bus bar 40 is so formed that both the tab terminal 15 of the low-profile fuse 10 and the tab terminal 25 of the fuse 20 can be attached thereto.

When the fuse 20 is going to be inserted obliquely into the housing 50, the tip 26 of the tab terminal 25 of the fuse 20 comes in contact with the guides 67A, 67B provided on the side walls 61 of the housing 50.

Therefore, it can be previously prevented from occurring that the tip 26 of the tab terminal 25 penetrates between an interior of the side walls 61 and the peripheral part 31*a* of the forked terminal 30, and consequently the forked terminal 30 or the tab terminal 25 is deformed or damaged permanently.

As shown in FIGS. 1, 9 and 15, slopes 67*c*, 67*d* are formed on the guide 67A at the opening 71 of the housing 50 to make a fuse insertion operation easier. Further, as shown in FIGS. 1 and 15, slopes 67*e*, 67*f* are formed on the guide 67B at the opening 71 of the housing 50 to make a fuse insertion operation easier.

As shown in FIGS. 1 and 15, slopes 67*c*, 67*d*, 67*e* and 67*f* are formed inward and upward on the pair of guides 67A, 67B at distal ends 67*g*, 67*h* to make a fuse insertion operation easier. As shown in FIG. 15, the four guides 67A and 67B are arranged at four corners of the 50 respectively.

The low-profile fuse 10 is inserted into the chamber 72 of the housing 50, while being guided by the slopes 67*c*, 67*d*, 67*e*, 67*f*. Therefore, the fuse 50 is inserted easier to the housing 50.

Figure 6:
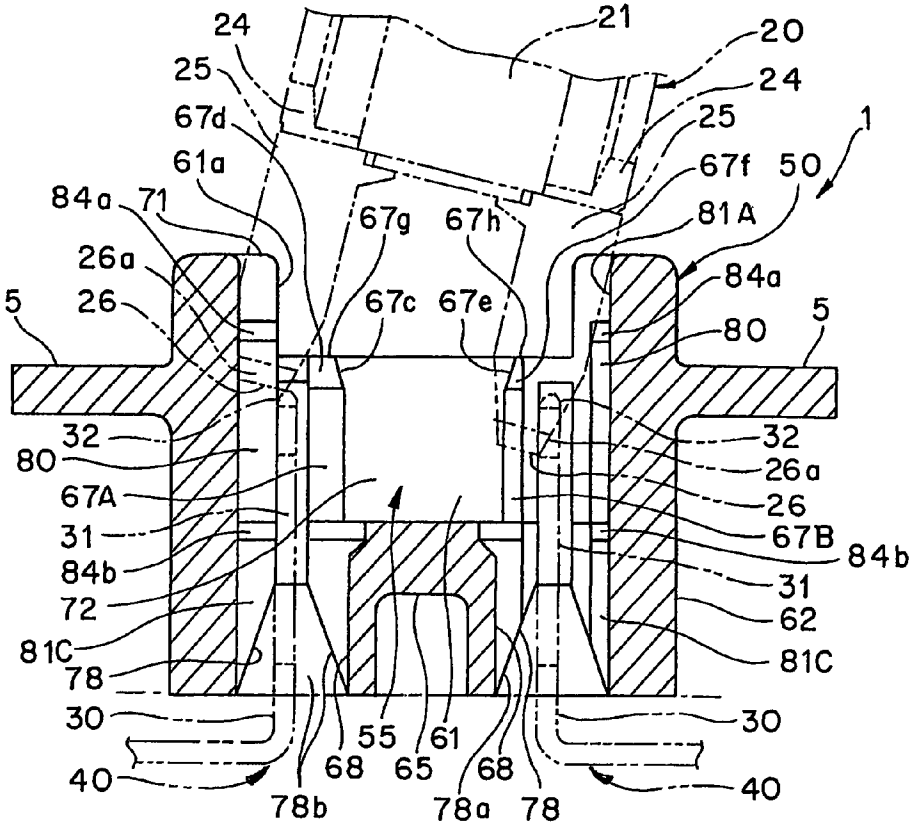
FIG. 6 is a longitudinal cross section view showing a state in which a tall-profile fuse is being attached to the housing according to this invention.

As shown in FIGS. 3, 6, 10, the guides 67*g*, 67*h* are taller than the free ends 32 of the forked terminal 30.

As shown in FIGS. 10, 11, when the low-profile fuse 10 is inserted from the opening 71 of the chamber 72, the guides 67A, 67B come in contact with the protective projection 12 of the low-profile fuse 10 earlier than the forked terminal 30 of the housing 50 comes in contact with the tab terminal 15 of the low-profile fuse 10.

Therefore, the low-profile fuse 10 is inserted into the chamber 72 of the housing 50, while being guided by the guides 67A, 67B. Therefore, the low-profile fuse 10 is prevented from being inserted obliquely into the housing 50.

Figure 14:
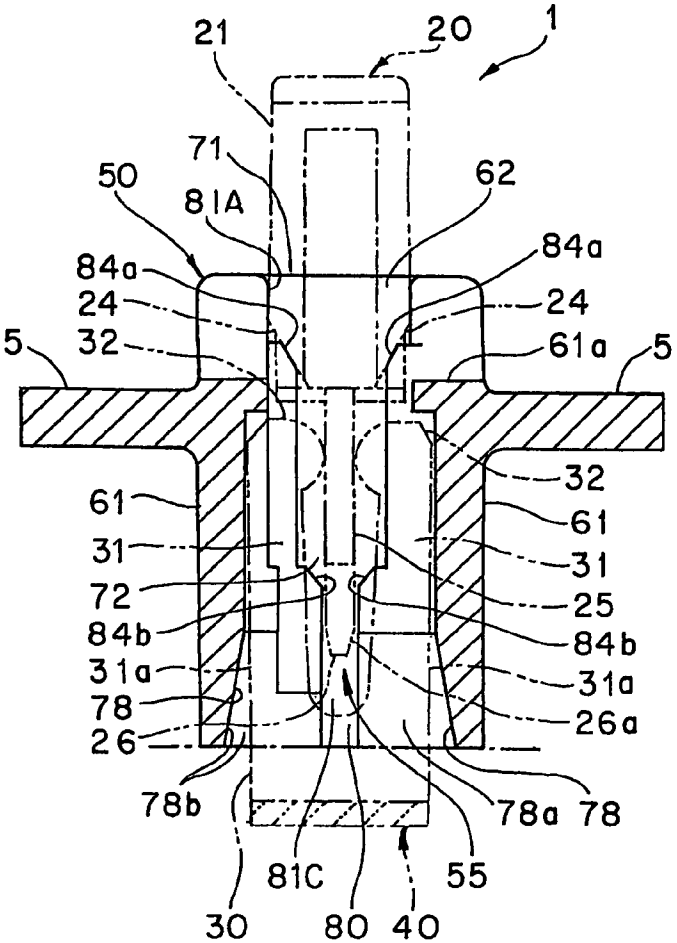
FIG. 14 is a transverse cross section view taken on line G—G of FIG. 17, showing the state in which the tall-profile fuse is attached to the housing.

As shown in FIGS. 8, 9 and 15, a groove 80 is formed on the side wall 62 of the housing 50. This groove 80 includes a widest part 81A at the opening 71 side, a wider straight part 81B continued to the wider part 81A, a narrower straight part 81C continued to the wide straight part 81B. As shown in FIG. 13, the widest part 81A is formed so as to be adapted to the head 13 of the low-profile fuse 10. Further, as shown in FIG. 14, the widest part 81A is also adapted to the fuse body 21 of the fuse 20. Further, as shown in FIGS. 1 and 15, a slot 68 is provided on the bottom wall 65 of the housing 50, corresponding to the narrower straight part 81C.

As shown in FIG. 14, a positioning part 84*a* is provided in between the widest part 81A and the wider straight part 81B, corresponding to a positioning part 24 of the fuse body 21. The positioning part 84*a* is formed as a slope 84*a* corresponding to a slope 24 of the fuse body 21.

Figure 7:
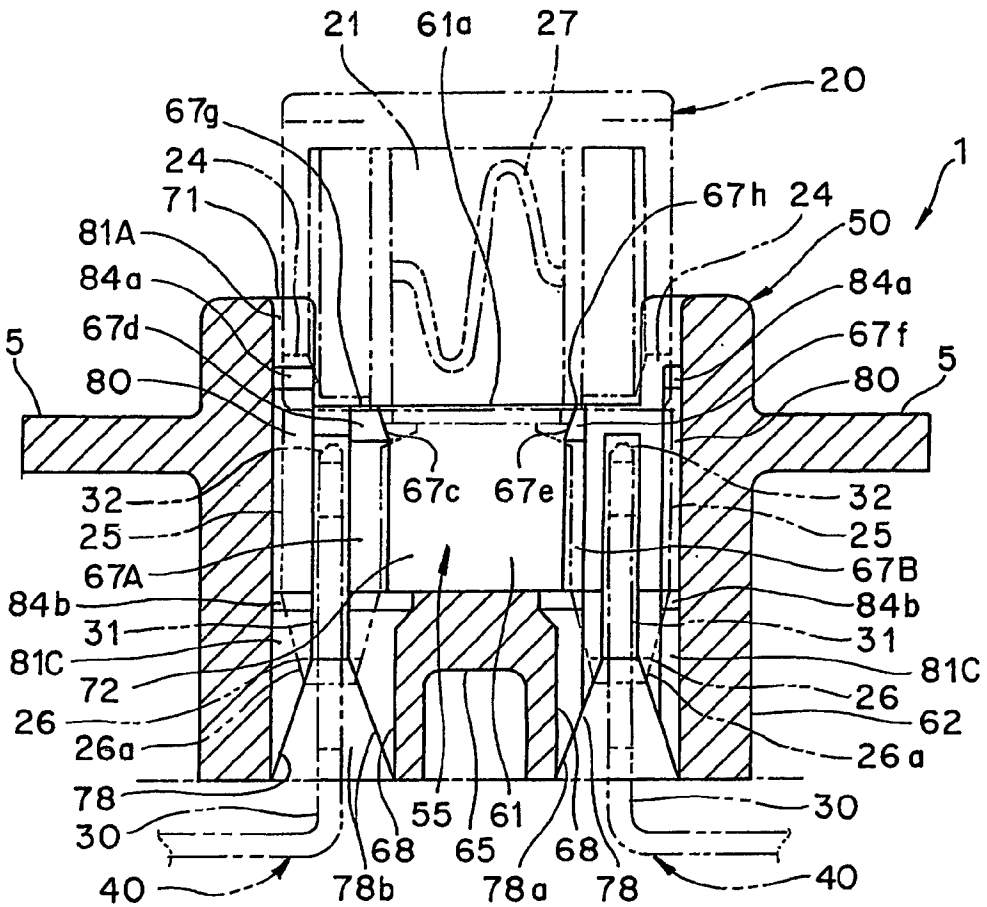
FIG. 7 is a longitudinal cross section view taken on line F—F of FIG. 17, showing a state in which the tall-profile fuse is attached to the housing.

Further, as shown in FIGS. 8 and 9, a slope 84*b* is formed in between the wider straight part 81B and the narrower straight part 81C, corresponding to the edge 26*a* of the tip 26 of the tab terminal 25. As shown in FIGS. 6, 7, 14, when the fuse 20 is inserted into the housing 50, the edge 26*a* of the tip 26 of the tab terminal 25 is guided along the slope 84*b*, and the tab terminal 25 is inserted into both the narrower straight part 81C of the groove 80 of the side walls 62 and the slot 68 of the bottom wall 65. Thus, the fuse 20 is inserted easily into the housing 50.

As shown in FIG. 3, the fuse cavity 55 is formed on the housing 50 as a component of an electric junction box 1. Further, the housing 50 including the fuse cavity 55 is a component of a fuse block body as a component of the electric junction box 1. For example, various electronic components and devices are mounted on the fuse block body, a lower cover (not shown) or an upper cover (not shown) to be assembled to said lower cover. Then, the electric junction box 1 is formed by assembling the fuse block body, the lower cover and the upper cover (not shown).

By providing the fuse cavity 55 on the housing 50 of the electric junction box 1, the electric junction box 1, on which fuses 10, 20 are mounted properly, is supplied to such as a car manufacturer. Further, the electric junction box 1, in which the tab terminal 15, the tab terminal 25 and the forked terminal 30 in the chamber 72 of the housing 50 are prevented from being damaged, is supplied to such as a car manufacturer. In the car manufacturer, the electric junction box 1 is mounted on a vehicle (not shown).

INDUSTRIAL APPLICABILITY

According to this invention, when the fuse is inserted into the housing, the projection is slid on the guide at the same time. Therefore, the fuse is prevented from being inserted obliquely into the housing, and properly attached to the housing. Thus, a damage as a permanent deformation of the terminal, caused by the terminal of the fuse penetrating into the gap between the inner wall of the housing and the terminal mounted on the housing, is prevented.

According to this invention, when the fuse is inserted into the housing, the slope, which is formed on an upper side of the guide of the housing, guides the fuse. Therefore, the fuse is easily inserted into the housing.

According to this invention, when the fuse is inserted into the housing, the guide of the housing comes in contact with the projection of the fuse earlier than the terminal mounted on the housing comes in contact with the terminal of the fuse. Therefore, a damage as a permanent deformation of the terminal, caused by the terminal of the fuse penetrating into the gap between the inner wall of the housing and the terminal mounted on the housing, is prevented.

According to this invention, said electric junction box allows the fuse to be properly attached to the fuse cavity. In addition, the terminal, being mounted on the housing in said electric junction box, can be prevented from being damaged by oblique insertion of the fuse.

The invention claimed is:

1. A fuse cavity having a housing to receive a fuse, comprising:

said fuse includes a fuse element;

terminals provided at both ends of the fuse element; and a fuse body, characterized in that a protecting projection protrudes from a middle part of said fuse body for protecting the fuse element and is disposed on said fuse body intermediate the terminals on the ends of the fuse element, and that said housing has a guide formed at a side wall of an inner part thereof, said guide being allowed to contact with said protecting projection of the fuse body so as to prevent said fuse from being inserted obliquely into the housing.

2. The fuse cavity as described in claim 1, wherein a slope is provided at the guide of said housing.

3. The fuse cavity as described in claim 2, wherein the guide of said housing is made taller than the terminal mounted on the housing.

4. The fuse cavity as described in claim 1 wherein the protecting projection is formed as an insulating housing in a substantially rectangular box shape.

* * * * *